United States Patent [19]

Veyhl

[11] Patent Number: 4,502,394

[45] Date of Patent: Mar. 5, 1985

[54] TABLE WITH ADJUSTABLE TABLE-TOP

[75] Inventor: Wolf Veyhl, Neuweiler, Fed. Rep. of Germany

[73] Assignee: Veyhl-Produktion KG, Neuweiler, Fed. Rep. of Germany

[21] Appl. No.: 377,404

[22] Filed: May 12, 1982

[30] Foreign Application Priority Data

May 20, 1981 [DE] Fed. Rep. of Germany ..... 3120126
Sep. 3, 1981 [EP] European Pat. Off. ..... 81106873.3

[51] Int. Cl.[3] ..... A47B 17/02

[52] U.S. Cl. ..... 108/6; 108/2; 108/136; 108/146

[58] Field of Search ..... 108/136, 1, 2, 6, 7, 108/146, 144; 312/313

[56] References Cited

U.S. PATENT DOCUMENTS

| | | | |
|---|---|---|---|
| 3,008,789 | 11/1961 | Bradley et al. | 312/316 |
| 3,238,900 | 3/1966 | Janus | 108/2 |
| 3,273,517 | 9/1966 | Amthor, Jr. et al. | 108/2 |
| 3,625,160 | 12/1971 | Bergman | 108/6 X |
| 3,638,584 | 2/1972 | Cisler et al. | 108/6 |
| 3,687,089 | 8/1972 | Hasbrouck et al. | 108/136 X |
| 4,196,675 | 4/1980 | Cook | 108/6 |
| 4,383,486 | 5/1983 | Reineman et al. | 108/6 X |
| 4,397,244 | 8/1983 | Rutsche et al. | 108/6 |

FOREIGN PATENT DOCUMENTS

| | | | |
|---|---|---|---|
| 32030 | 2/1885 | Fed. Rep. of Germany . | |
| 2131468 | 1/1972 | Fed. Rep. of Germany | 108/6 |
| 7630881 | 2/1976 | Fed. Rep. of Germany . | |
| 3018216 | 2/1981 | Fed. Rep. of Germany | 108/136 |
| 1046405 | 10/1966 | United Kingdom . | |

*Primary Examiner*—William E. Lyddane
*Assistant Examiner*—Thomas A. Rendos
*Attorney, Agent, or Firm*—Burmeister, York, Palmatier, Hamby & Jones

[57] ABSTRACT

In a table comprising a table-top that can be adjusted in height and/or inclination relative to the trestle, and a spring arrangement provided between the trestle and the table-top and serving to counterbalance the weight of the table, the table-top (6) is connected to the trestle at its rear edge by disengageable stops and at its front edge by clamps. The spring arrangement comprises a torsion bar spring (11) mounted preferably on the trestle (1) and provided with at least two radial arms (15, 21) bearing against the trestle (1) and the lower face of the table-top (6), respectively. Such a spring arrangement is of particularly simple design and requires only little space. Further, the torsion bar spring offers a favorable spring characteristic. A particularly soft spring effect can be achieved by the use of a stack of leaf springs (31) as torsion bar spring. The stop arrangement comprises pins (61) projecting from the rear edge of the table-top into a cable duct (2) where they are held by a toothed slide (64). The clamps are formed by clamping pieces (90) which can be displaced in opposite directions by rotating a threaded spindle (82) seated at the front edge of the table-top, coacting with fixed abutments (88,89), the said clamping pieces (90) and abutments (88,89) bearing against opposite faces of the wall (86) of a hollow section (5) of the trestle (1).

20 Claims, 8 Drawing Figures

TABLE WITH ADJUSTABLE TABLE-TOP

FIELD OF THE INVENTION

The present invention relates to a table comprising a table-top that can be adjusted in height and/or inclination relative to the trestle, and a spring arrangement provided between the trestle and the table-top and serving to counterbalance the weight of the table-top.

BACKGROUND OF THE INVENTION

Tables comprising table-tops which can be adjusted to the optimum working height and/or inclination have been known for a long time and are recently finding ever broader application, in particular as tables for EDP equipment where they permit the adjustment of the optimum height of the keyboard and display screen. The adjustment of the table-top is rendered possible, for instance, by the use of worm drives. But drives of this type are very expensive which makes them unsuited for the more economical models of such tables. In tables of this latter category one therefore provides simple stop means at leg portions arranged to slide relative to each other, which stop means serve to retain the table-top at different heights and/or inclinations. The adjustment of the table-top must be effected manually. Arrangements of this type may be provided with spring means to counterbalance the weight of the table-top and, thus, to simplify the adjustment of the table-top to the desired position. The spring arrangements used heretofore to serve this purpose consisted of helical springs or gas springs arranged within the leg portions of the table-top. But helical springs have an unfavourable spring characteristic in so far as the spring force varies in proportion to the compression of the spring so that relatively long springs must be used if excessive variations of the spring force are to be avoided when the table-top is adjusted in height. Similar problems are encountered also with gas springs as their spring force varies in proportion to the enclosed gas volume. Moreover, gas springs are relatively expensive which fact also sets certain limits to their use. It is a common feature of all such springs that they occupy considerable space in the trestle leg portions.

SUMMARY OF THE INVENTION

Now, the present invention has for its object to provide a table of the type described above with an adjusting mechanism and spring arrangement of simple design which can be produced at low cost, occupies only little space and which moreover is easy to handle, and this largely because of an efficient counterbalancing mechanism.

According to the invention, this problem is solved by the features that the table-top has its edge detachably fastened to the trestle by stop means and/or clamps and that the spring arrangement comprises a torsion bar spring mounted to the trestle or the table-top and provided with at least two radial arms bearing against the trestle and the lower face of the table-top, respectively.

The torsion bar spring used in the table of the invention has a very favourable characteristic in so far as, provided the arms mounted thereat are of corresponding length, it will be twisted only through a small angle so that the spring force exerted by it will undergo only small variations. Further, such a torsion bar spring is an extremely simple and, therefore, inexpensive component, and the torsion bar spring may be held at the lower face of the table-top or the trestle in simple bearings which likewise can be realized at low cost. In addition, the space requirements of such a torsion bar spring mounted in parallel to the table-top is practically negligible. And further, it provides a support for the centre of the table-top so that the latter can be tilted relative to the said support. This makes it possible to provide very simple stop or clamping means at the edges of the table-top, which also require little space and which can be operated individually one after the other as no parallel displacement of the table-top becomes necessary when the latter is raised or lowered. So, all the requirements listed above are simultaneously met by the arrangement of the invention.

A particularly favourable distribution of forces is achieved when the ends of the torsion bar spring are provided with two parallel arms resting against the same table component and when one arm resting against another component is provided at the centre portion of the torsion bar spring. This provides a large spring base for the spring bearing against the one component and the loadtransmitting arms bearing against the other component so that the formation of unfavourable tilting moments is effectively prevented.

In a preferred embodiment of the invention, the torsion bar spring is mounted on a component arranged parallel to one edge of the table-top and comprises at least one arm extending substantially to the centre line of the table-top extending in parallel to the said edge. Such an arrangement is particularly space-saving and, at the same time, particularly easy to realize. The torsion bar spring may, for instance, be arranged in parallel to the longitudinal edge of the table-top and have the arms mounted to its ends bear against the table-top. Such an arrangement proves to be particularly convenient in cases where the trestle comprises two lateral frame portions and a traverse interconnecting the same and serving preferably as a cable duct, because in this case the torsion bar spring may be simply fastened at the lower face of the said traverse.

When the table-top is being adjusted in height, the end of the arm which rests against the component of the table arranged to move relative to the torsion bar spring, i.e. in particular the lower face of the table-top, performs simultaneously a movement in a direction vertical to the said component because its end describes an arc of a circle. Accordingly, it is advantageous to provide the end of this arm with a caster in order to avoid any undesirable friction between the end of the arm and the said component.

Further, the at least one arm resting against the table component carrying the torsion bar spring, i.e. for instance the traverse interconnecting the lateral frame portions of the trestle, may be provided with a set screw bearing against the said component and providing the possibility to adjust the spring tension.

In a preferred embodiment of the invention, the torsion bar spring is seated in a carrying tube and provided at its two ends projecting from the said carrying tube with one arm each. In this arrangement, the arms arranged at the ends of the torsion bar spring may in particular extend in parallel to each other, and the carrying tube may be provided at its centre portion with a slot with another arm mounted to the torsion bar spring projecting therefrom. The carrying tube may be fastened at the lower face of a mounting plate so that the spring arrangement forms one complete unit that can be produced independently of the remaining table and then mounted at the table when necessary, in particular at a traverse of the trestle. In this arrangement, it is also possible to provide the set screw on the arm projecting from the slot in the carrying tube and to let the set screw bear against the lower face of the mounting plate so that the set screw will at any time have a sufficiently strong support against which to bear.

It is of particular advantage to give the torsion bar spring a triangular or polygonal, preferably square cross-section. Profile bars of a suitable steel and suitable cross-section for the production of the torsion bar springs can be easily obtained on the market. They offer the advantage that no special measures must be taken to mount the arms on the torsion bar spring so that they will rotate with the latter. Rather, it will suffice to provide the arms with corresponding recesses of a cross-section adapted to the torsion bar spring and to fasten them on the torsion bar spring for instance by means of clamps, to ensure that the arms will rotate with the spring. In a preferred embodiment of the invention, the torsion bar spring is formed by a stack of superimposed leaf springs which together preferably exhibit a square cross-section. Such a torsion bar spring formed by leaf springs has an even more favourable spring characteristic than a massive torsion bar and results in even lower variations of the spring force when the load-transmitting arms are pivoted relative to each other. In such an arrangement, the openings provided in the arms and adapted to the cross-section of the leaf spring stack will suffice to hold the leaf springs together.

A particular simple embodiment of the invention is obtained when the arms are directly formed by sections of the torsion bar spring bent off at an angle. In this case, there is no need to mount arms of a rigid material at the ends of the torsion bar springs. If such a torsion bar spring is provided with an arm mounted at its centre, this arm may be formed by a U-shaped section of the torsion bar spring. Such a spring may also be fastened to the lower face of a mounting plate, but in this case it will be necessary to use split brackets because due to its bent-off ends the torsion bar spring cannot be introduced into carrying tubes, unless this is done before the ends of the torsion bar spring are bent off. In such an embodiment of the invention, the casters may be replaced with particular advantage by slide shoes which can be simply slipped on to the ends of the bent-off portions of the torsion bar spring forming the arms. But it is also possible to attach casters to torsion bar spring sections that have been bent off once more.

In a preferred embodiment of the invention, stop means are provided on one edge of the table-top, which stop means consist of a pin mounted on at least one edge of the table-top and extending in parallel to the plane of the table-top, which projects into a vertical slot provided in a hollow section of the trestle. In the hollow section, there is guided a horizontally adjustable slide which comprises a toothed edge defining the stop positions and which in its engaged position retains the pin between one pair of its teeth. In this embodiment of the invention, the pin provided at the edge of the table-top is positively retained and, thus, securely fixed in place in the horizontal direction by the vertical slot and in the vertical direction by the pair of teeth of the slide between which it is engaged. The particular advantage of this arrangement is to be seen in the fact that no exposed holding members for the table-top impair the appearance of the table and that the slide arranged within the hollow section of the trestle may also have the shape of a flat plate which does not require much space. At the same time, the design of this arrangement is extremely simple so that it can be produced at low cost.

In this embodiment of the invention, the teeth may have a triangular cross-section, and the slide may be resiliently biassed towards its rest position. In this manner, an arrangement absolutely free from play is achieved because the spring acts to urge the edges of the teeth against the pin and, at the same time, the pin against the opposite edge of the vertical slot. Thus, the table-top is fixed in position, absolutely free from play.

This arrangement is of particular advantage in cases where the trestle comprises a cable duct adjoining the rear edge of the table-top, because in this case the slide may be located within this cable duct which on the one hand provides sufficient room for the slide and, on the other hand, provides easy access to the slide after removal of the cable duct cover, without there being a need for any exposed actuation members for the slide.

As mentioned before, the table-top may be connected with the trestle also by means of clamps. In one preferred embodiment of the invention, the table-top is retained in clamping relationship by a rotary spindle arranged in parallel to one edge of the table-top and projecting with its ends into vertical slots provided in adjacent hollow sections of the trestle. The ends of the said spindle are provided with oppositely directed threads coacting with corresponding threads provided in clamping pieces which are fixed against rotation but which, by rotating the spindle, can be moved towards an abutment which is fixed relative to the spindle. In this arrangement, the abutment and the clamping piece are provided on opposite sides of the wall of the associated hollow section provided with the slot so that this wall can be firmly clamped between the abutment and the clamping piece to retain the table-top in the desired position. This arrangement also does not require much space as the spindle may be embedded in the table-top and as the hollow sections of the trestle provide sufficient space for the accommodation of the components of the clamping device arranged therein.

A particuarly simple arrangement is obtained when the threaded spindle is arranged within a rectangular tube provided along one edge of the table-plate, and held therein by clamping pieces taking the form of blocks guided in the said rectangular tube. In this case, the abutments can be easily attached to the ends of the threaded spindle which project into the hollow sections of the trestle. In this embodiment of the invention there is no need either for special bearings for the threaded spindle nor for any particular measures for the arrangement of the abutments. The abutments may for instance be formed by simple counter nuts provided at the ends of the threaded spindle or else by nuts fixed in a different manner, for instance by pins or welding. As an additional measure, a disk of a size corresponding approximately to the cross-section of the clamping pieces may be arranged between the nuts and the adjacent wall of the hollow section, and the side of the disk facing the wall of the hollow section may be provided with a toothing to ensure that the table-top be firmly retained in place relative to the trestle even when heavily loaded.

The threaded spindle must be provided with some means permitting it to rotate. Such means may for instance consist in flat portions or a transverse bore permitting the application of a wrench or a rod to facilitate rotating the spindle. Otherwise, the threaded spindle may also be equipped with a permanently attached radially projecting handle, although the attachment of such a handle would demand relatively high precision in the production of the clamping handle if a safe clamping and releasing effect is to be achieved within the rotary movement available which will hardly exceed a range of 180°. Still, the lever may under certain circumstances project from the lower face of the table-top at an angle into the space beneath the table and interfere with the user's feet. A preferred embodiment of the invention has, therefore, the handle connected with the threaded spindle by means of a two-way ratchet. Ratchets are devices consisting of toothed segments and locking members and widely used on tools to transmit a rotary movement in one direction only.

BRIEF DESCRIPTION OF THE DRAWINGS

The invention will be described hereafter with reference to one example shown in the drawing. In other embodiments of the invention, the features appearing from the specification and the drawing may be used either individually or in any desired combination. In the drawing.

DETAILED DESCRIPTION OF ILLUSTRATIVE EMBODIMENTS

Figure 1:
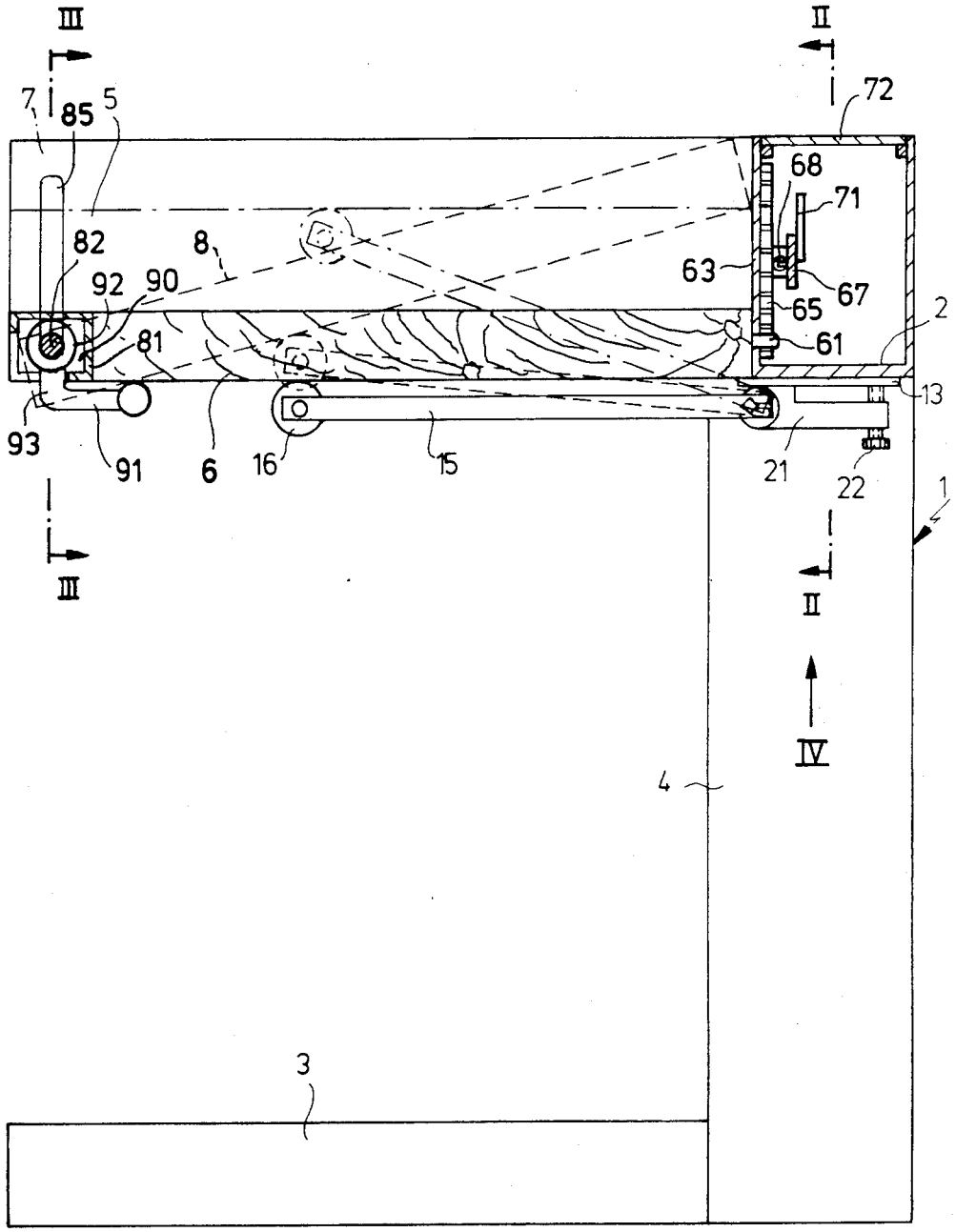
FIG. 1 shows a cross-section through a table equipped with an adjusting mechanism according to the invention.
Figure 2:
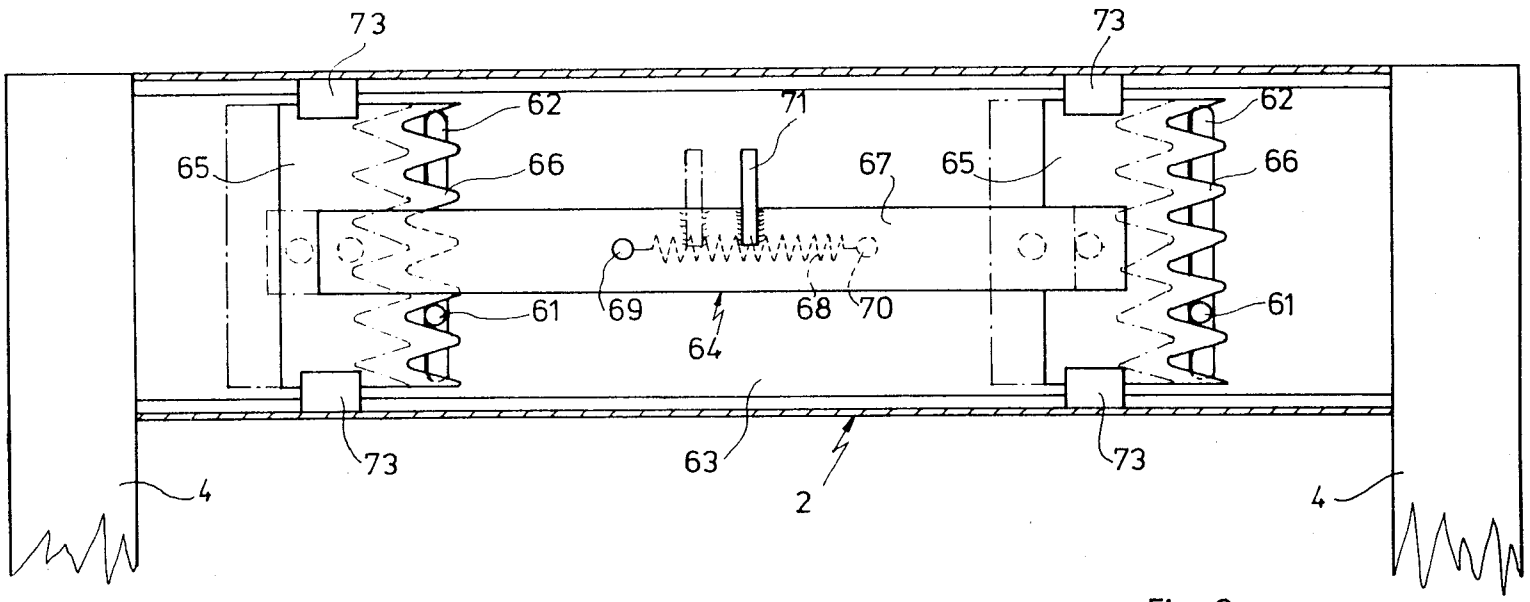
FIG. 2, a section along line II—II through the table of FIG. 1.
Figure 3:
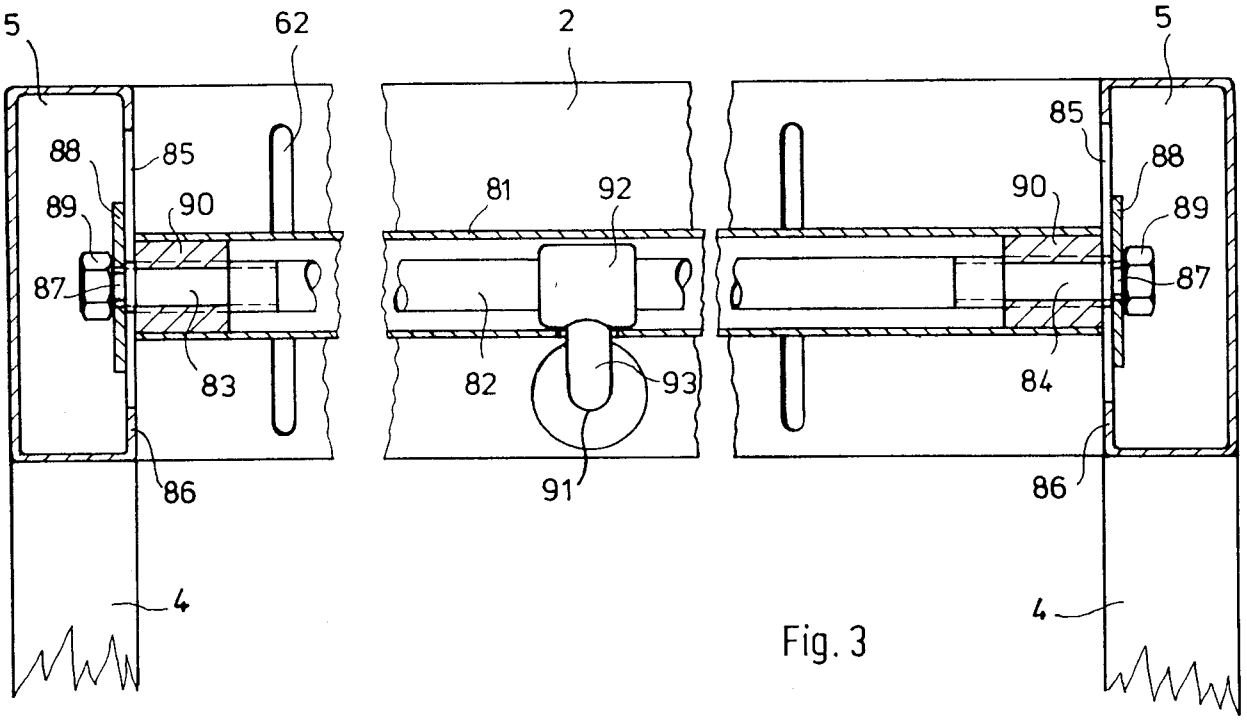
FIG. 3, a section along line III—III through the table of FIG. 1.

The table shown in FIGS. 1 to 3 comprises a trestle consisting of two lateral portions 1 and one traverse 2 interconnecting the said lateral portions which in the embodiment shown takes the form of a cable duct. The lateral portions 1, of which only one is shown in FIG. 1, are substantially C-shaped and comprise a foot 3, a leg portion 4 mounted on the rear end of the foot and an upper frame portion 5 extending in parallel to the foot. The traverse 2 and the frame portions 5 form a rectangle which is open towards the front of the table and which encloses the table-top 6. The table-top 6 is fastened to the traverse 2 in the frame portions 5 by means of stop and clamping members. It may be raised from its lower position shown in FIG. 1 to an upper position 7 indicated by dash-dotted lines and in addition tilted into an inclined position 8 as indicated by dashed lines. Several intermediate positions are possible.

For mounting the table-top 6 to the traverse 2, the table-top 6 is provided at its rear edge with two spaced pins 61 extending in parallel to the plane of the table-top and projecting into vertical slots 62 provided in the front wall 63 of the traverse 2 which takes the form of a cable duct. At the inner face of the front wall 63 there is provided a slide 64 comprising two plates 65 arranged substantially beside the slots 62. The edge of the plates 65 facing the slots 62 is provided with teeth 66 of substantially triangular cross-section. In the inclined position shown in FIG. 2, each of the pins 61 is retained by a pair of associated teeth 66 which thus determine the position of the said pins in the longitudinal direction of the slot 62. The two plates 65 are interconnected by a bar 67 and pulled by a spiral tension spring 68 into the stop position shown in the drawing. One end of the spiral tension spring 68 is attached to a bolt 69 provided on the bar 67, while its other end is attached to a bolt 70 provided on the wall 63 of the cable duct. A handle 71 attached at about the centre of the bar 67, for instance by welding, enables the slide to be displaced in the longitudinal direction of the cable duct 2. This handle 71 is accessible after removal of the cover 72 of the cable duct.

The slide 64 can be displaced, against the action of the spiral tension spring 68, in the longitudinal direction of the cable duct 2 into the position indicated by dash-dotted lines in which the teeth 66 do no longer project across the slot 62 so that the pins 61 can be freely displaced along the slots 62 to adjust the height of the table-top. When the slide is released, the pins 61 are again engaged between two teeth 66 and retained by them in the selected stop position. The action of the spring causes the edges of the teeth 66 which form between them an angle, to bear against two opposite points of the pins 61 so as to simultaneously urge the pin against the opposite edge of the slot 62 so that the pin 61 is held in position free from play.

The slide 64 is held in the cable duct 2 by two guide members 73 gripping between them the upper and lower edges of the plates 65.

As will be seen in particular in FIG. 3, a rectangular tube 81 is arranged at the front edge of the table-top 6. This rectangular tube 81 encloses a spindle 82 which has its ends provided with oppositely directed threads 83 and 84 which preferably take the form of trapezoidal threads of great pitch. The spindle 82 projects from both ends of the rectangular tube 81 and into vertical slots 85 which are provided for this purpose in the inner walls 86 of the hollow-section frame portions 5. The two end portions of the spindle 82 take the form of pivots 87 of reduced diameter, each of the said pivots carrying a disk 88 retained in position by a nut 89. The disks 88 bear against the shoulder between the pivot 87 and the adjacent portion of the spindle 82 provided with the thread 83 or 84. Each of the last-mentioned spindle portions carries a block 90 serving as shim. The cross-section of the blocks 90 is adapted to that of the rectangular tube 81 so that they are fixed within the said tube against rotation, with only little play, but movable in the longitudinal direction of the tube. The blocks 90 have a female thread coacting with the threads 83 and 84, respectively. At the same time, the said blocks serve as bearing for the spindle 82. It appears that the blocks 90 can be displaced in the longitudinal direction of the rectangular tube 81 by rotating the spindle 82. This means that the blocks can be symmetrically advanced towards the disks 88 arranged on the ends of the spindle 82. Considering, however, that the disks 88 are fixed to the spindle 82 they act as fixed abutments bearing against the inner faces of the wall 86 of the frame portions 5, while the blocks 90 act as shims which are urged against the outer faces of the same walls. Thus, the walls are firmly clamped between the disks 88 and the blocks 90 so that any displacement of the spindle 82 in the longitudinal direction of the slots 85 relative to the frame portions 5 is rendered impossible and the table-top is securely held in place relative to the frame portions 5 also at its front edge. The clamping action may still be increased by providing the face of the disks 88 facing the walls 86 with a toothing or serration capable of digging itself into the material of the walls.

By rotating the spindle 82 in the opposite direction, the blocks 90 may be moved in a direction away from the abutments 88 to release the clamping effect. Now, the spindle 82 can be displaced in the longitudinal direction of the slots 85 to adjust the height of the front edge of the table-top. Thereafter, the clamping arrangement may be tightened to firmly retain the front edge of the table-top in any desired vertical position. It appears that, contrary to the step-wise adjustment of the rear edge of the table-top, this arrangement makes the front edge of the table-top infinitely adjustable.

In cases where no frequent adjustments of the table-top are to be expected, it may be sufficient to provide the spindle 82 at an easily accessible point with means permitting the application of a tool. These means may, for instance, consist of flat portions permitting the application of a wrench, or of a cross-bore for insertion of a handle in the form of a lever. But it is of course also possible to equip the spindle 82 with a radially projecting handle by means of which the spindle 82 can be actuated at any time. In the example shown in the drawing, such a handle 91 is connected with the spindle 82 via a two-way ratchet 92 shown in diagrammatic form only. For the purpose of reversing the active direction of the said ratchet, the handle 91 is bent off at an angle of 90° relative to its portion 93 extending radially to the spindle 82, and can be pivoted over 180°. Two-way ratchets have been known in many forms and are used in particular on tools serving to transmit a rotary movement at points which restrict the rotary movement of the tool to a very small range. The use of such a ratchet in the described clamping arrangement offers the particular advantage that it is not necessary to consider already at the production stage what position will be assumed by the hand lever when the full clamping effect is achieved, because the hand lever can be moved to and fro until the desired clamping effect is achieved and thereafter brought into a position where it does not interfere with the user. In particular, it may be applied against the lower face of the table-top as shown in the drawing.

The described locking means enable the front and rear edges of the table-top to be independently adjusted in height so that the table-top can be brought in any desired position by changing the height of one edge of the table-top and tilting it about the other edge which is retained in its given position. In the described example, free tilting is permitted by the pin arrangement provided at the rear edge of the table-top, while the clamping means at the front edge of the table-top should be released a little to reduce the frictional forces encountered during the tilting process. An adjustment of the type described will be particularly easy when spring means are provided which tend to bring the table-top into its uppermost position, in which case it will suffice to exert a certain pressure upon the table-top to bring the latter into the desired position. The table of the invention is equipped for this purpose with a spring arrangement capable of counterbalancing the weight of the table-top.

In the example shown in FIGS. 1 to 6, the spring arrangement comprises a torsion bar spring 11 seated in tube sections 12 fixed to the lower face of a mounting plate 13, for instance by welding. The ends 14 of the torsion bar spring 11 project beyond the tube sections 12 and carry each one arm 15 carrying on its end a caster 16. Each of the casters 16 is seated on a pivot pin 17 screwed into the end of the arm 15.

The torsion bar spring 11 exhibits a square cross-section, and the arms 15 are provided at their ends connected to the torsion bar spring 11 with corresponding square openings with a slot 18 extending from each of the said openings to the neighbouring end of the arm 15. In the area of this slot, clamping screws 19 are provided for fixing the arms 15 on the ends 14 of the torsion bar spring 11. The arrangement of the openings in the arm 15 is such that one diagonal extends in the longitudinal direction of the arm 15. In the area of this slot, between the two tube sections 12, the torsion bar spring 11 is provided with another arm 21 extending in parallel to the mounting plate 13, from the torsion bar spring 11 provided near the edge of the mounting plate 13 to the edge of the mounting plate opposite the torsion bar spring 11. The free end of the said arm 21 carries a set screw 22 bearing against the adjacent side of the mounting plate 13. To fix the arm 21 to the torsion bar spring 11, the arm 21 is likewise provided with a square opening 23 (FIG. 6) for receiving the spring 11. The opening 23 has two lateral faces extending in parallel to the longitudinal direction of the lever 21. The lever 21 is held in position by a set screw 24 bearing against the torsion bar spring 11.

Due to the different arrangement of the openings in the levers 15 and 21, respectively, the arms 15 and 21 form between them an angle of 45° when the torsion bar spring 11 is released, while in the extended position shown in FIGS. 2 and 3, which also corresponds to the operative position shown in FIG. 1 with lowered table-top 6, the torsion bar spring 1 is tensioned, the amount of such tension being adjusted to ensure that the force exerted upon the lower face of the table-top 6 by the ends of the two arms 15 which have their casters 16 bear against the lower face of the table-top 6—as shown in FIG. 1—is slightly greater than the weight of the table-top. The set screw 22 makes it possible to vary the position of the central arm 21 relative to the mounting plate 13 and, thus, also relative to the operative positions of the outer arms 15, to change the spring force and to adapt it, for instance, to table-tops of different size or different materials so that one and the same spring arrangement can be used for tables of different design.

As will be seen in FIG. 1, the spring arrangement just described is attached to the lower face of the traverse 2 by means of the mounting plate 13. The length of the arms 15 provided on the ends of the torsion bar spring 11 is such that their casters 16 come to bear against the lower face of the table-top 6 at about the middle of its longitudinal extension. Accordingly, the table-top is supported substantially along an axis extending through the centre of gravity so that it can be easily brought into the desired position. In FIG. 1, the positions of the arms 15 corresponding to the positions 7 and 8, respectively, of the table-top 2 are also shown in dash-dotted and dashed lines, respectively.

As mentioned before it is important for the ease of handling that the torsion bar spring be "as soft as possible", i.e. that the force exerted by the spring on the table-top be as constant as possible. Although the spring characteristic even of a solid torsion bar spring is already favourable in this respect, the characteristic of the torsion bar spring may be further improved by giving it the form of a stack of leaf springs. As appears from FIG. 6, the torsion bar spring 11 of the example shown in the drawing consists of six superimposed leaf springs 31 which are held together solely by the openings in the attached arms 15 and 21.

Figure 8:
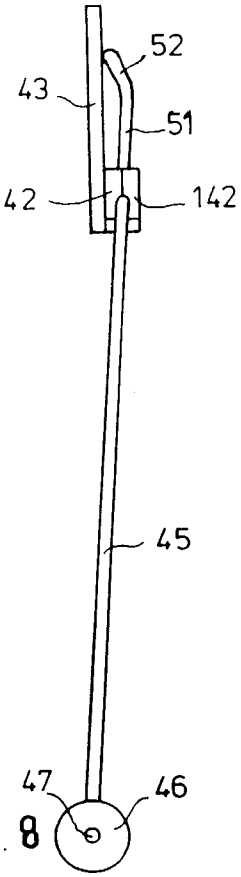
FIG. 8, a side view of the spring arrangement shown in FIG. 7.
Figure 7:
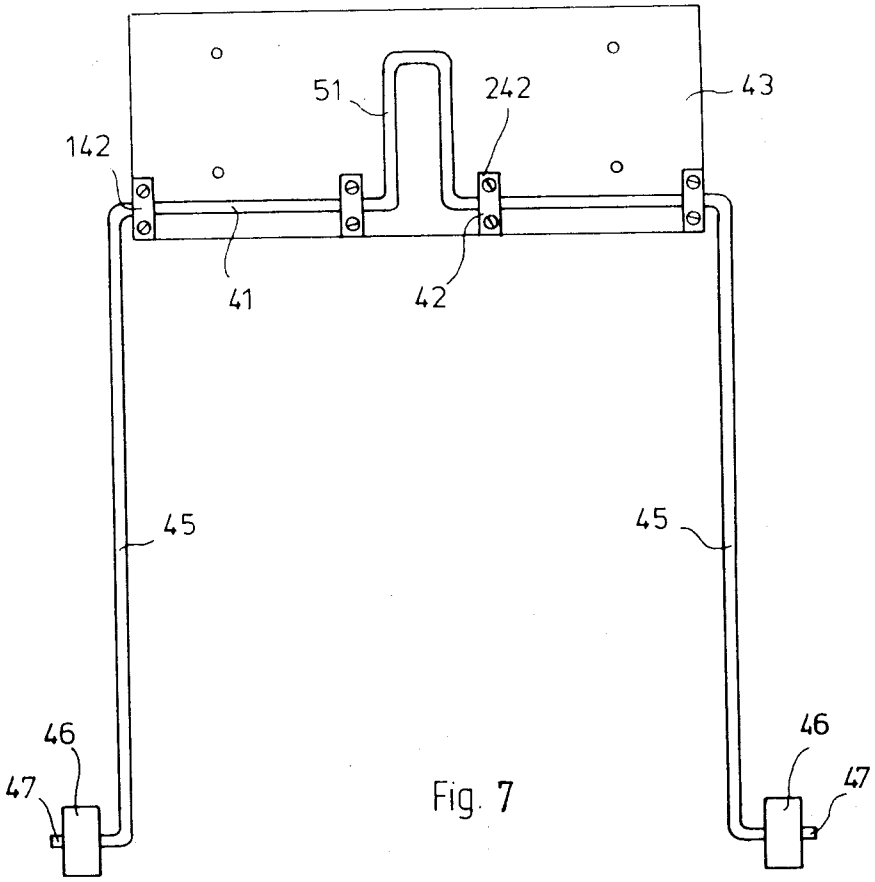
FIG. 7, a view of another spring arrangement similar to that shown in FIG. 4.

In the embodiment of the spring means for a table in accordance with the invention shown in FIGS. 7 and 8, the torsion bar spring 41 is again mounted on the lower face of a mounting plate 43 intended to be fastened to the trestle of a table, as in the case of the example described before.

In the present example, the torsion bar spring 41 consists of a bar of circular cross-section with a diameter of, for instance, 8 mm. The torsion bar spring 41 of the present example is not seated in tube sections, but rather in brackets 42 attached to the lower face of the mounting plate 43, for instance again by welding. But the brackets are split along a plane parallel to the mounting plate 43 so as to form sort of bearing caps 142 which are fastened by means of screws 242 to the bracket portions 42 mounted on the mounting plate 43 and which make it possible to position the torsion bar spring 41 in the brackets when the latter are open. The arms 45 provided at the ends of the torsion bar spring 41 are simply formed, in this embodiment of the invention, by bent-off end portions of the spring bar which have their respective ends once more bent-off to form pivots 47 carrying the casters 46 and extending in parallel to the section of the torsion bar spring supported on the mounting plate 43.

The centre portion 51 of the torsion bar spring is bent into the shape of a U. When the spring is in the operative condition, i.e. biassed, this portion is oppositely directed to, but in one and the same plane with the arms 45, while a slightly bent-off end portion 52 of the said U-shaped centre portion 51 bears against the adjacent face of the mounting plate. The initial stress of the spring may be influenced by changing the angle which is formed between the end 52 and the remaining portion of the U-shaped section 51.

Figure 5:
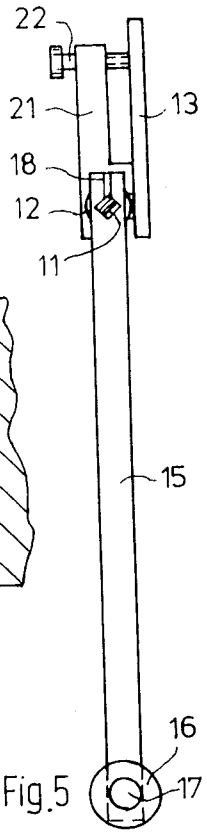
FIG. 5, a side view of the spring arrangement of FIG. 4.
Figure 6:
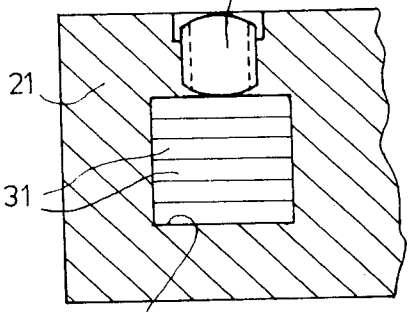
FIG. 6, a section along the line VI—VI and showing a detail the spring arrangement of FIG. 4, in greatly enlarged scale.
Figure 4:
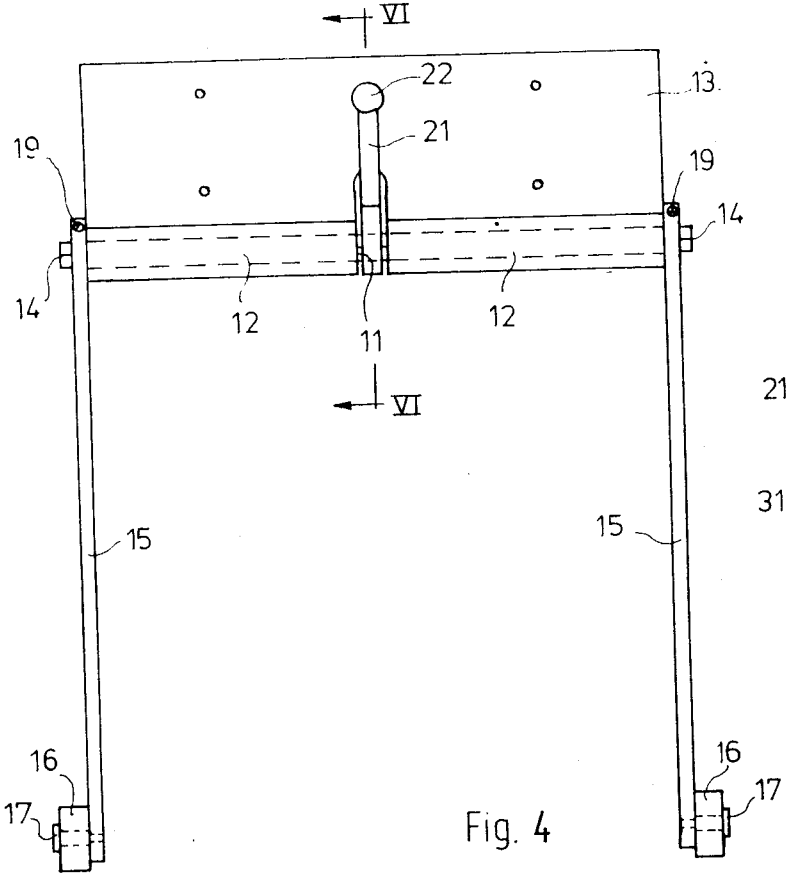
FIG. 4, a view of the spring arrangement of the table of FIG. 1, viewed in the direction indicated by arrow IV.

It appears that this spring arrangement distinguishes itself by a particularly simple design, although it can be used in the same manner as the spring arrangement shown in FIGS. 4 to 6.

In the case of spring arrangements for tables of usual size, the mounting plate may have a surface area of approx. $100\times260$ mm$^2$. The spring arms may have a length of approx. 300 mm which gives an arm distance of likewise approx. 300 mm. While a diameter of 8 mm will be generally sufficient when solid rounds are used for the production of the torsion bar spring, it has been found that in the case of a stack of leaf springs of square cross-section, the bar cross-section should conveniently have a lateral length of 12 mm. As a rule, however, the dimensions will depend on the properties of the material used for the torsion bar spring, the table size, the type of the spring arrangement and the manner in which it is attached, and the forces to be absorbed.

It goes without saying that the invention is in no way limited to the examples described but that certain variations are possible without leaving the scope of the invention. So, one could for instance envisage to mount the torsion bar spring at the lower face of the table-top and to provide it with arms bearing against upwardly directed faces of the trestle, for instance against a truss arranged beneath the table-top. Or else, the ends of the torsion bar spring could be formed simply by bending off the end portions of the bar only so that only two arms are obtained. If a symmetrical arrangement is desired, as in the examples described, two such springs could for instance be used in symmetrical arrangement. The arms could carry on their ends slide shoes instead of casters. Where bent-off ends of the torsion bar spring serve as arms, such arms could, instead of being themselves equipped with a set screw, bear against a vertically adjustable abutment. The stop means of the table-top could also be of different design. In particular, it could be envisaged to provide similar stop means on two opposite edges of the table-top. In any case, the arrangements to be selected will largely depend on the design of the trestle of which the invention is absolutely independant.

What is claimed is:

1. An adjustable table,
comprising a table-top component,
a trestle component,
connecting means for connecting said table-top component to said trestle component for height adjustment of at least a portion of said table-top component,
and spring means between said components for counterbalancing the weight of the table-top component,
said spring means comprising a torsion bar spring,
mounting means for mounting said spring on one of said components,
said torsion bar spring having two opposite end portions and a central portion,
said torsion bar spring having two parallel arms mounted on said opposite end portions of said spring and engaging one of said components,
said torsion bar spring having a third arm on said central portion of said spring and engaging the other component,
whereby said torsion bar spring and said arms resiliently exert counterbalancing force between said trestle component and said table-top component.

2. An adjustable table according to claim 1,
said mounting means being mounted on said trestle component.

3. An adjustable table according to claim 1,
said mounting means being mounted on said trestle component,
said two arms engaging said table-top component,
said third arm engaging said trestle component.

4. An adjustable table according to claim 1,
including an adjustable screw mounted on said third arm and engaging the corresponding component for adjusting the force resiliently exerted by said torsion bar spring and said arms.

5. An adjustable table according to claim 1,
said mounting means including a carrying tube for supporting said torsion bar spring,
and a mounting plate secured to said carrying tube for mounting said carrying tube on one of said components.

6. An adjustable table according to claim 5,
said carrying tube having opposite end portions and a center portion,